US007681320B2

(12) United States Patent
Szczepanowski et al.

(10) Patent No.: US 7,681,320 B2
(45) **Date of Patent: *Mar. 23, 2010**

(54) SHAVING RAZORS AND RAZOR CARTRIDGES

(75) Inventors: Andrew Szczepanowski, Walpole, MA (US); Robert A. Trotta, Pembroke, MA (US)

(73) Assignee: The Gillette Company, Boston, MA (US)

( * ) Notice: Subject to any disclaimer, the term of this patent is extended or adjusted under 35 U.S.C. 154(b) by 252 days.

This patent is subject to a terminal disclaimer.

(21) Appl. No.: 11/013,228

(22) Filed: Dec. 15, 2004

(65) Prior Publication Data

US 2006/0123631 A1 Jun. 15, 2006

(51) Int. Cl.
*B26B 21/48* (2006.01)
*B26B 21/52* (2006.01)
*B26B 21/38* (2006.01)

(52) U.S. Cl. ..... 30/530; 30/527; 30/50; 30/44; 30/34.05

(58) Field of Classification Search ..... 30/44, 30/45, 47, 526, 527, 50, 34.05
See application file for complete search history.

(56) References Cited

U.S. PATENT DOCUMENTS

| | | | | |
|---|---|---|---|---|
| 1,505,578 A | | 8/1924 | Barra | |
| 1,552,026 A | * | 9/1925 | Barra | 30/34.05 |
| 1,817,925 A | * | 8/1931 | Marcy | 30/68 |
| 2,018,147 A | | 10/1935 | Pirvitz | |
| 2,063,808 A | | 12/1936 | Henderson et al. | |
| 2,164,581 A | | 7/1939 | Ewald | |
| 2,225,257 A | | 12/1940 | Conill | |
| 2,231,219 A | | 2/1941 | Peterson | |
| 2,323,169 A | * | 6/1943 | Wagenhals | 427/191 |
| 2,324,148 A | | 7/1943 | Gravin | |

(Continued)

FOREIGN PATENT DOCUMENTS

| | | |
|---|---|---|
| DE | 575 523 | 4/1933 |

(Continued)

OTHER PUBLICATIONS

Magrab, Edward B. Integrated Product and Process Design and Development. CRC Press LLC. 1997. pp. 144, 166, 170.*

(Continued)

*Primary Examiner*—Kenneth E. Peterson
*Assistant Examiner*—Sean Michalski
(74) *Attorney, Agent, or Firm*—John M. Lipchitz; Kevin C. Johnson; Steven W. Miller

(57) ABSTRACT

Shaving razors and razor cartridges are provided. In one embodiment, a razor is provided including (a) a handle, (b) a head, separable from and pivotally mounted on the handle, the head including a housing that is positioned to contact the user's skin during shaving and that carries one or more blades configured for wet shaving, (c) an electrical circuit, configured to power an electrical function associated with the head, a first portion of the circuit being disposed in the handle and a second portion of the circuit being disposed in the head, and (d) an electro-mechanical connector, pivotally joining the head to the handle, configured to provide electrical communication between the first and second portions of the circuit.

13 Claims, 7 Drawing Sheets

U.S. PATENT DOCUMENTS

| | | | | | |
|---|---|---|---|---|---|
| 2,386,536 | A | * | 10/1945 | Bensel | 30/47 |
| 2,622,319 | A | | 12/1952 | Hunt | |
| 3,364,568 | A | | 1/1968 | Lowy | |
| 3,648,368 | A | | 3/1972 | Douglass et al. | 30/60.5 |
| 3,934,115 | A | | 1/1976 | Peterson | |
| 4,253,013 | A | | 2/1981 | Mabuchi | 219/521 |
| 4,347,663 | A | * | 9/1982 | Ullmo | 30/47 |
| 4,364,104 | A | * | 12/1982 | Holahan et al. | 362/223 |
| 4,864,735 | A | | 9/1989 | Chung | |
| RE33,306 | E | * | 8/1990 | Hayashi et al. | 429/336 |
| 5,011,439 | A | * | 4/1991 | Pawlicki | 439/847 |
| 5,046,249 | A | | 9/1991 | Kawara et al. | 30/45 |
| 5,113,585 | A | | 5/1992 | Rogers et al. | 30/41 |
| 5,191,712 | A | | 3/1993 | Crook et al. | 30/34.2 |
| 5,299,354 | A | | 4/1994 | Metcalf et al. | 30/45 |
| 5,394,777 | A | | 3/1995 | Kozikowski | 83/15 |
| 5,454,164 | A | | 10/1995 | Yin et al. | 30/41 |
| 5,653,025 | A | | 8/1997 | Cheng et al. | 30/41 |
| 5,794,342 | A | | 8/1998 | Davey | 30/45 |
| 5,956,851 | A | * | 9/1999 | Apprille et al. | 30/47 |
| 6,035,537 | A | * | 3/2000 | Apprille et al. | 30/346.5 |
| 6,158,125 | A | | 12/2000 | Dolev | 30/43.6 |
| 6,421,918 | B1 | | 7/2002 | Dato et al. | 30/45 |
| 6,430,813 | B2 | | 8/2002 | Muraguchi et al. | |
| 6,481,104 | B1 | * | 11/2002 | Parker et al. | 30/45 |
| 6,574,866 | B2 | | 6/2003 | Pragt et al. | 30/34.2 |
| 6,763,590 | B2 | | 7/2004 | Guimont et al. | |
| 6,817,101 | B1 | * | 11/2004 | Bohmer | 30/34.05 |
| 6,836,966 | B2 | * | 1/2005 | Patrick | 30/34.05 |
| 6,977,474 | B2 | * | 12/2005 | Ueda et al. | 318/128 |
| 7,024,775 | B2 | * | 4/2006 | Uchiyama | 30/43.92 |
| 7,441,336 | B2 | * | 10/2008 | Hawes et al. | 30/45 |
| 2001/0023538 | A1 | | 9/2001 | Muraguchi et al. | |
| 2002/0096512 | A1 | | 7/2002 | Abbott et al. | 219/543 |
| 2002/0189102 | A1 | | 12/2002 | Orloff | 30/41.7 |
| 2003/0046816 | A1 | | 3/2003 | Kanzer | 30/32 |
| 2003/0154832 | A1 | | 8/2003 | Guimont et al. | |
| 2003/0226258 | A1 | * | 12/2003 | Patrick | 30/34.05 |
| 2004/0045948 | A1 | | 3/2004 | Shalev et al. | 219/223 |
| 2004/0074097 | A1 | | 4/2004 | Guimont et al. | |
| 2005/0172493 | A1 | * | 8/2005 | Fischer et al. | 30/45 |
| 2006/0032055 | A1 | * | 2/2006 | Simms et al. | 30/34.05 |
| 2006/0070242 | A1 | * | 4/2006 | Szczepanowski et al. | 30/140 |
| 2009/0255123 | A1 | * | 10/2009 | Tomassetti et al. | 30/34.05 |

FOREIGN PATENT DOCUMENTS

| | | | |
|---|---|---|---|
| DE | 2 801 845 | | 7/1979 |
| FR | 520 234 | | 6/1921 |
| FR | 749 861 | | 8/1933 |
| FR | 840 502 | | 4/1939 |
| FR | 985 030 | | 7/1951 |
| FR | 2716402 | * | 2/1994 |
| FR | 2 716 402 | | 5/1995 |
| FR | 2716402 | * | 8/1995 |
| FR | 2716402 A1 | | 8/1995 |
| WO | WO 92/13684 | | 8/1992 |

OTHER PUBLICATIONS

Prototron Circuits. Chart. (http://www.prototron.com/plating.html © 2003).*

"thefreedictionary.com/crimped". definitions tr.v. 1, 2 and n. 2,c. Viewed Feb. 8, 2007.*

"dictionary.Cambridge.org/define.asp?hey=crimp*1+0&dict=A". Viewed Feb. 8, 2007.*

Magrab, Edward B. Integrated Product and Process Design and Development. CRC Press LLC. 1997. p. 144.*

"Electrical connector" Wikipedia. http://en.wikipedia.org/wiki/Electrical_connector. Viewed Feb. 8, 2007.*

Magrab, Edward B. "Integrated Product and Process Design and Development". Chapter 7 "design for Assembly and Disassembly". Heading 7.2 "Design for Assembly". p. 143. © 1997 by CRC Press LLC. Boca Raton, FL.*

* cited by examiner

SHAVING RAZORS AND RAZOR CARTRIDGES

TECHNICAL FIELD

This invention relates to shaving razors and razor cartridges, and more particularly to razors for wet shaving.

BACKGROUND

Users of wet-shave razors generally appreciate a feeling of warmth against their skin during shaving. The warmth feels good, resulting in a more comfortable shave.

Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery.

Wet shaving devices may also be provided with a battery-powered vibrating function. Reciprocating, vibrating, or oscillating motion razors, referred to collectively herein as "vibrating razors," are described, for example, in U.S. Pat. Nos. 5,046,249, 5,299,354, 5,794,342 and 6,481,104, the disclosures of which are incorporated herein by reference. Some vibrating razors include a rotary motor with an eccentric element for imparting oscillating motion.

Other electrical devices may also be provided in wet shaving devices. For example, U.S. 2002/0189102 describes a razor including force sensors and an indicator configured to signal when the blades of the razor need to be replaced.

Many wet shaving razors include a blade unit, commonly referred to as a cartridge that is removably mounted on the handle so that the blade unit can be replaced by a new blade unit when the sharpness of the blades has diminished to an unacceptable level. The blade unit may be pivotally mounted on the handle, to enhance maneuverability of the blade unit relative to the handle during shaving.

SUMMARY

In general, in one aspect, the invention features a wet shaving razor having a removable, pivotally mounted blade unit in electrical communication with a handle on which the blade unit is mounted.

In one aspect, the invention features a razor including (a) a handle, (b) a head, separable from and pivotally mounted on the handle, the head including a housing that is positioned to contact the user's skin during shaving and that carries one or more blades configured for wet shaving, (c) an electrical circuit, configured to power an electrical function associated with the head, a first portion of the circuit being disposed in the handle and a second portion of the circuit being disposed in the head, and (d) an electro-mechanical connector, pivotally joining the head to the handle, configured to provide electrical communication between the first and second portions of the circuit.

In some implementations, the electrical circuit is configured to heat the housing. The razor may instead, or additionally, be configured to vibrate during shaving.

The electro-mechanical connector includes pivot journals through which electrical communication takes place. The pivot journals may be plated, e.g., with a metal selected from the group consisting of nickel, chromium and alloys thereof, and a non-plated area may be provided between the pivot journals. Alternatively, the pivot journals may be formed in part or entirely of a solid metal or an electrically conductive plastic.

The invention also features methods of shaving using the razors and cartridges discussed above.

The term "razor", as used herein, unless otherwise indicated refers both to razors that include a handle and a replaceable cartridge, and to disposable razors in which the razor head is fixedly mounted on a handle.

The details of one or more embodiments of the invention are set forth in the accompanying drawings and the description below. Other features and advantages of the invention will be apparent from the description and drawings, and from the claims.

DESCRIPTION OF DRAWINGS

FIG. 7 shows the assembled razor from the back. FIGS. 7A and 7B show the cartridge exploded from the handle, from the back and front, respectively. (Only the housing portion of the cartridge is shown in FIG. 7B, for clarity.)

DETAILED DESCRIPTION

Figure 1:
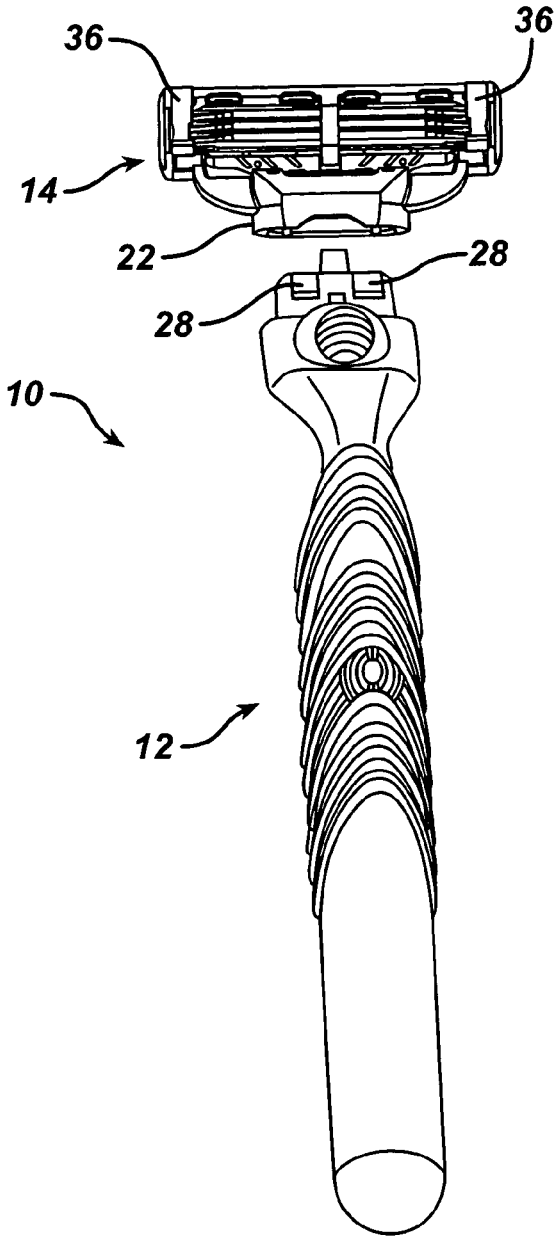
FIG. 1 is a plan view of a razor having a pivotally mounted cartridge.
Figure 2:
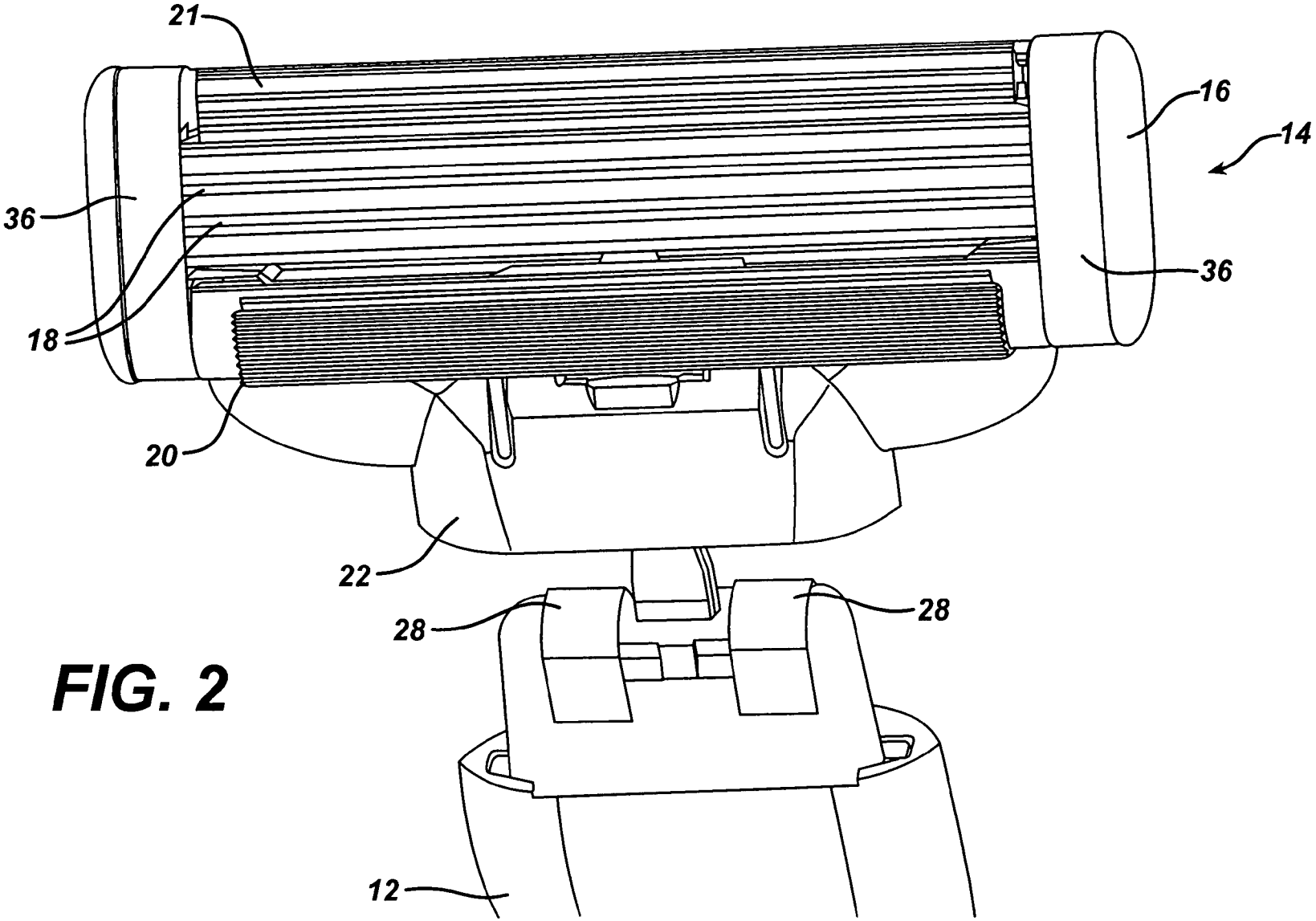
FIG. 2 is an enlarged perspective view of the cartridge and a portion of the handle of the razor shown in FIG. 1, with the cartridge exploded from the handle.

Razor 10, shown in FIG. 1, includes a handle 12, and, mounted on the handle, a razor cartridge 14. Referring to FIG. 2, razor cartridge 14 includes a molded plastic housing 16, which carries a plurality of blades 18 and a guard 20 mounted forward of the blades. Cartridge 14 is removably mounted on handle 12 by an electro-mechanical connector 22.

The guard 20 may include, as shown in FIG. 2, a finned unit molded on the front of housing 16 to engage and stretch the user's skin; other skin engaging protrusions, e.g., as described in U.S. Pat. No. 5,191,712, which is hereby incorporated by reference, can be used. The razor cartridge 14 may also include other components that improve the performance or extend the life of the cartridge. For example, a piece of aluminum (not shown) may be included at one end to act as a sacrificial anode. Also, a shaving aid composite 21 may be provided at the upper edge of the housing 16 to deliver a lubricious substance to the user's skin, e.g., as described in U.S. Pat. Nos. 5,113,585 and 5,454,164, the disclosures of which are hereby incorporated by reference.

Figure 1A:
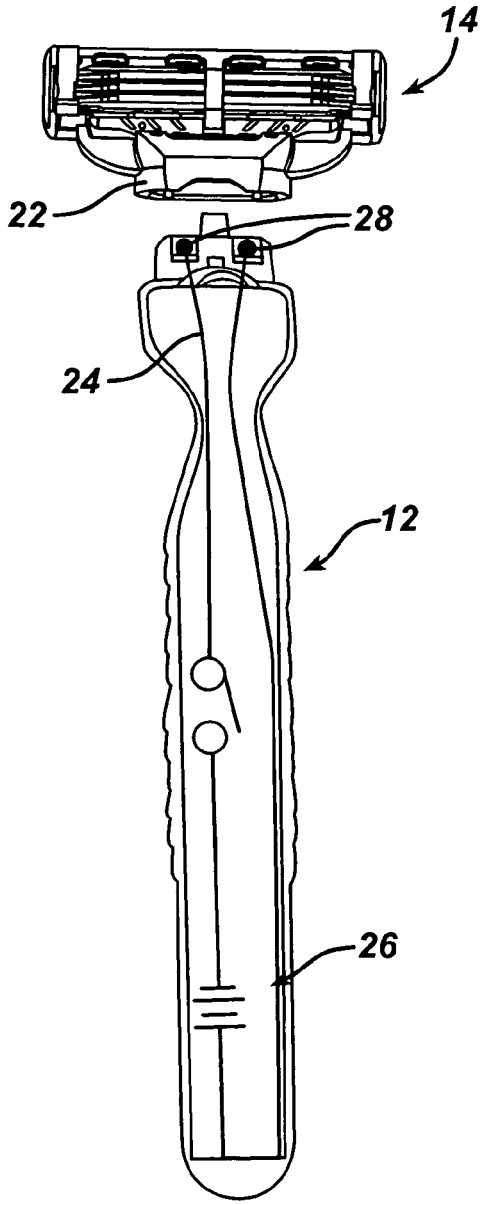
FIG. 1A is a diagrammatic view of the razor, showing the circuitry within the razor handle.

Referring to FIG. 1A, the razor includes a circuit 24 to which current is supplied by one or more batteries 26 disposed in a hollow portion of handle 12. The batteries may be rechargeable, in which case the razor may be configured to be mounted in electrical communication with a recharging station (not shown). The circuit 24 includes a first portion in the handle 12, and a second portion (not shown) in the cartridge 14. For example, the circuit 24 may include a relatively high resistance area (e.g., a resistor) embedded in the plastic housing 16 to provide heating in that area of the housing. Alternatively, the circuit may power other types of electrical devices associated with the cartridge.

For example, the razor may instead, or additionally, include a vibrating feature. Reciprocating, vibrating, or oscillating motion razors, referred to collectively herein as "vibrating razors," are described, for example, in U.S. Pat. Nos. 5,046,249, 5,299,354, 5,794,342 and 6,481,104, the disclosures of which are incorporated herein by reference. The razor may include a rotary motor, which may include an eccentric element for imparting oscillating motion. Alternatively, the motor may be a linear motor. The motor, which may be an electric motor, is housed within the handle and has an output shaft with an eccentric weight mounted thereon. Energization of the motor results in a high speed rotation of the eccentric weight and thereby vibration of the razor and the blade unit in particular. It is generally preferred that heat and vibration are delivered to the same area of the head at substantially the same time.

Razors that provide heat, or both heat and vibration, to the head are described in U.S. application Ser. No. 10/956,752, titled "Shaving Razors and Razor Cartridges" and filed on Oct. 1, 2004, the entire disclosure of which is incorporated by reference herein.

Figure 3:
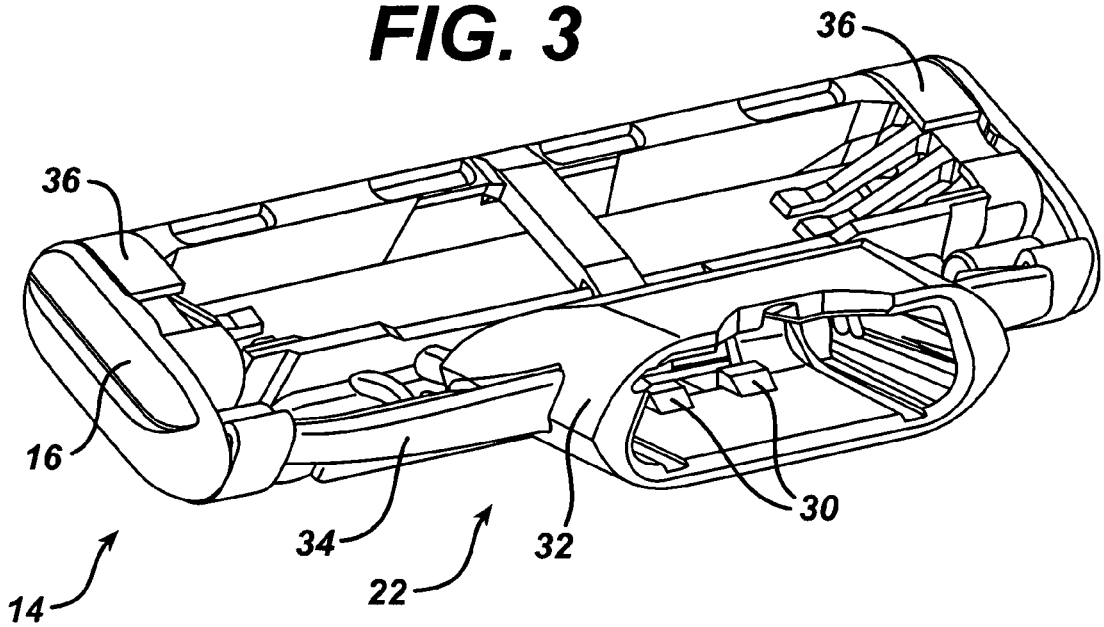
FIG. 3 is a highly enlarged perspective view of the cartridge shown in FIG. 1, with the blades removed for clarity.
Figure 4:
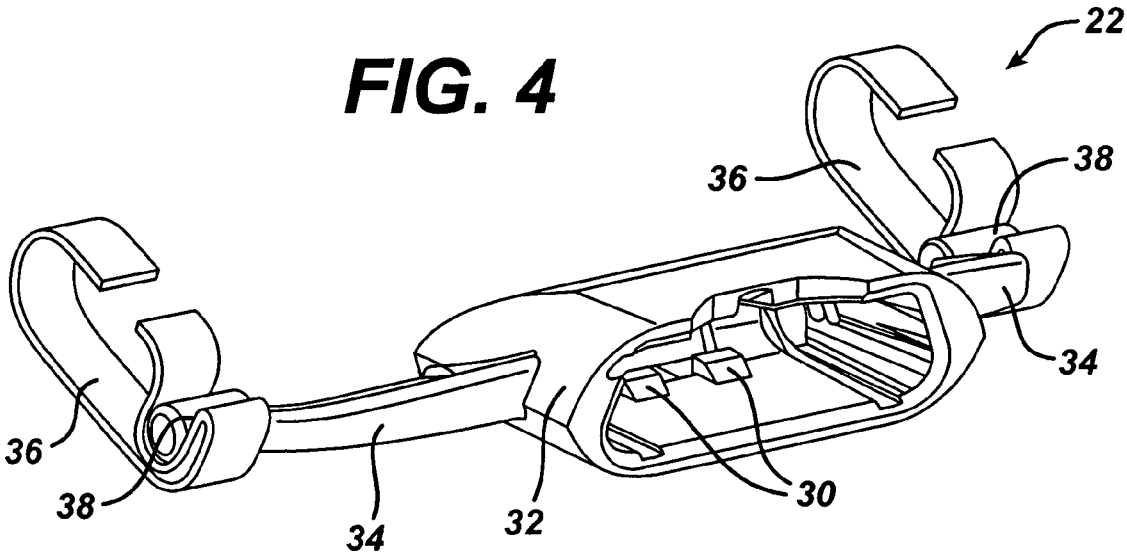
FIG. 4 is a highly enlarged perspective view of a clip/pivotal interconnect portion of the cartridge shown in FIG. 3.

Electrical connection between the first and second portions of the circuit 24 is provided by the electro-mechanical connector 22, which is shown in detail in FIGS. 3-6. The electro-mechanical connector 22 is configured to allow the cartridge 14 to pivot with respect to the handle 12 while maintaining electrical communication between the portion of the circuit in the handle and the portion of the circuit in the cartridge. In the embodiment shown in FIGS. 1-2, electrical communication is provided by (a) an electrically conductive plating (not shown) on the electro-mechanical connector 22, (b) contacts 28 on the handle, and (c) corresponding contacts or other conductive features 30 on the cartridge (FIG. 3).

Figure 5:
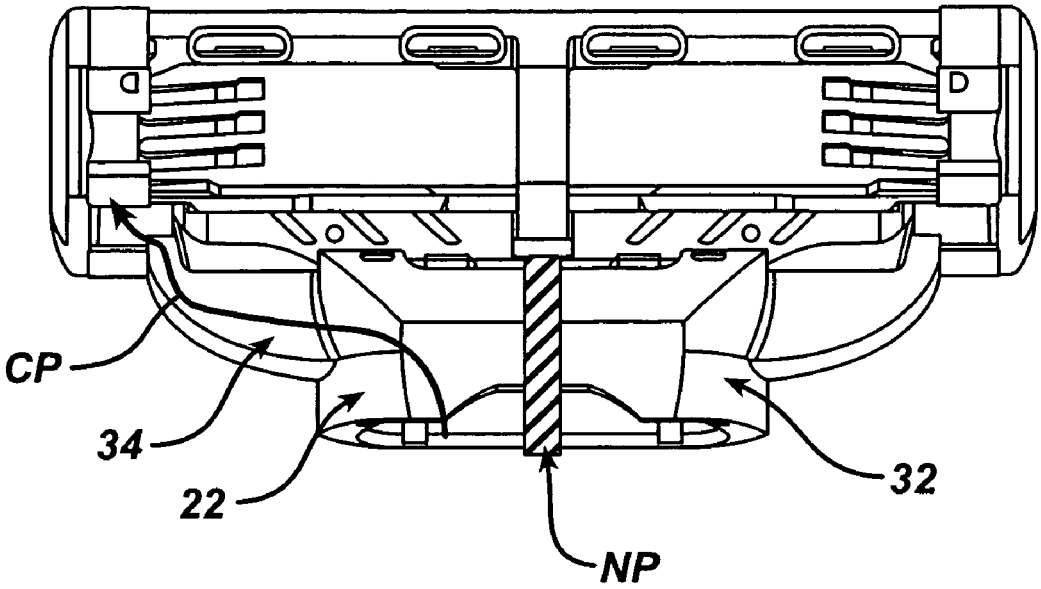
FIG. 5 is a diagrammatic view showing a current path through the cartridge shown in FIGS. 1-3.
Figure 6:
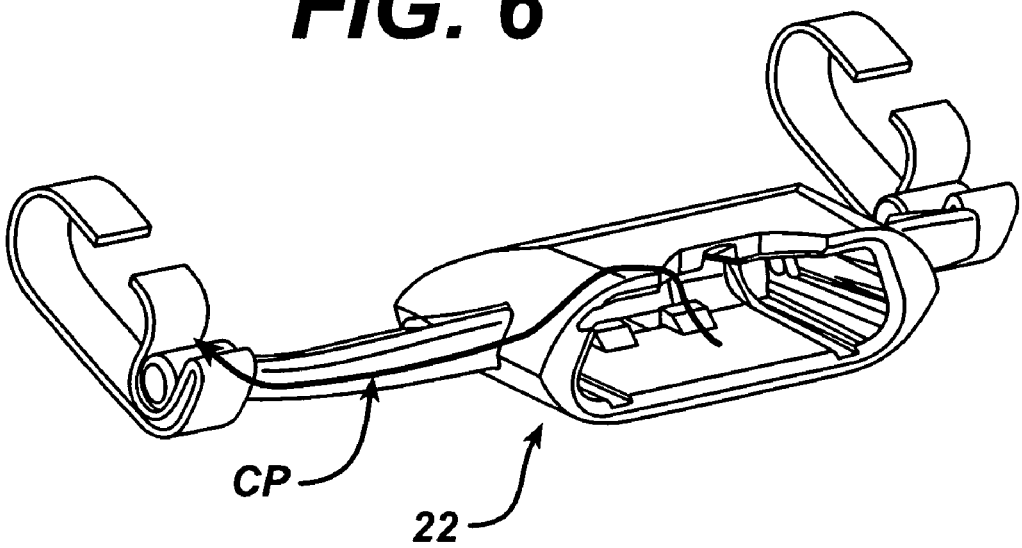
FIG. 6 is a diagrammatic view showing the current path through the clip/pivotal interconnect shown in FIG. 4.

Referring to FIG. 3, the electro-mechanical connector 22 includes a handle-receiving portion 32, which contains contacts 30, a pair of wings 34 that extend from the handle-receiving portion, and pair of clips 36 that are pivotally mounted on end portions 38 of the wings. As shown in FIG. 2, in the finished cartridge the clips 36 are crimped around the housing 16 both to hold the blades in place, as is well known in the razor field, and to provide a path for current (CP) from the contacts 30 through the electro-mechanical connector 22 and to the housing (FIGS. 5 and 6). The back surface of each clip (the surface that contacts the blades) is insulated, to prevent a short due to contact between the clips and blades. The insulation may be, for example, a coating, tape or insert of an electrically insulating material such as plastic.

As indicated diagrammatically in FIG. 5, all of the electro-mechanical connector 22 is plated with the exception of area NP. This area serves to separate the current paths on the two sides of the connector and prevent a short-circuit. Area NP can be provided, for example, by masking this area of the connector 22 during plating or by forming area NP of a plastic that does not plate well. The plated area may be plated, for example, with nickel, chromium, or alloys thereof. The plating may have a thickness of from about 0.0001" to 0.005". Alternatively, the conductive path CP may be provided by other means, e.g., by insert molding lead wires into the plastic of the connector. If desired, the conductive areas may be formed in part or entirely of a solid metal, rather than being plated as described above. In other implementations, the conductive areas may be formed in part or entirely of an electrically conductive plastic. Suitable electrically conductive polymers include carbon and graphite filled polymers. Preferably, the electrically conductive polymer has a resistance of less than about 2 (10E) ohms/sq measured according to ASTM D257. Moreover, part or all of CP may be formed of a conductive material that is assembled externally onto the cartridge, e.g., by clipping or press-fitting.

The electro-mechanical connector may be used to provide electrical communication for other purposes, for example voltage feedback, temperature control, and "SMART" electronics, i.e., a circuit that can sense when the razor is in contact with the skin and thereby activate another circuit that provides a function such as heating, vibration or dispensing.

Other embodiments are within the scope of the following claims.

Figure 7:
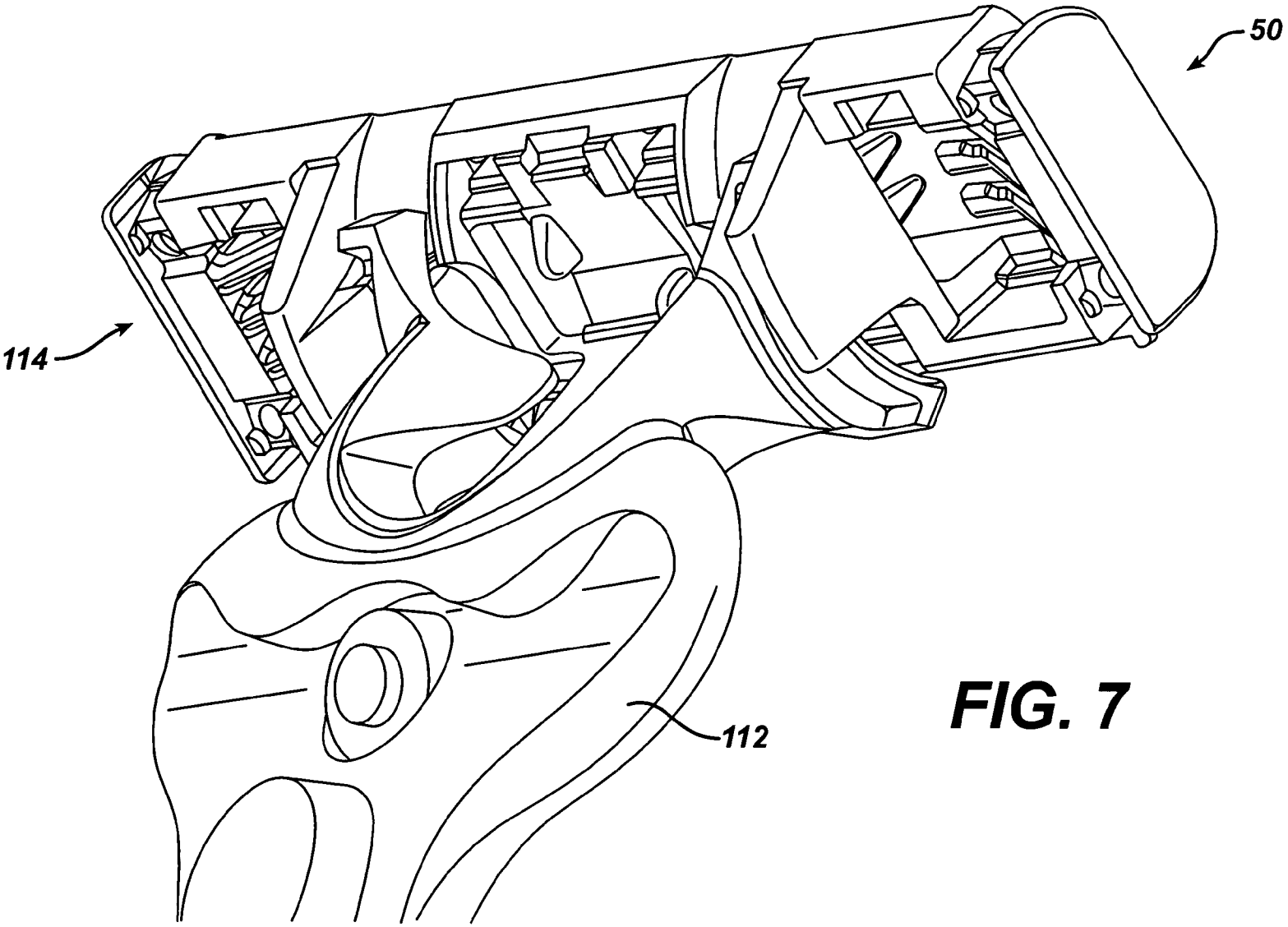
FIGS. 7, 7A and 7B are partial perspective views of a razor according to an alternative embodiment of the invention.
Figure 7A:
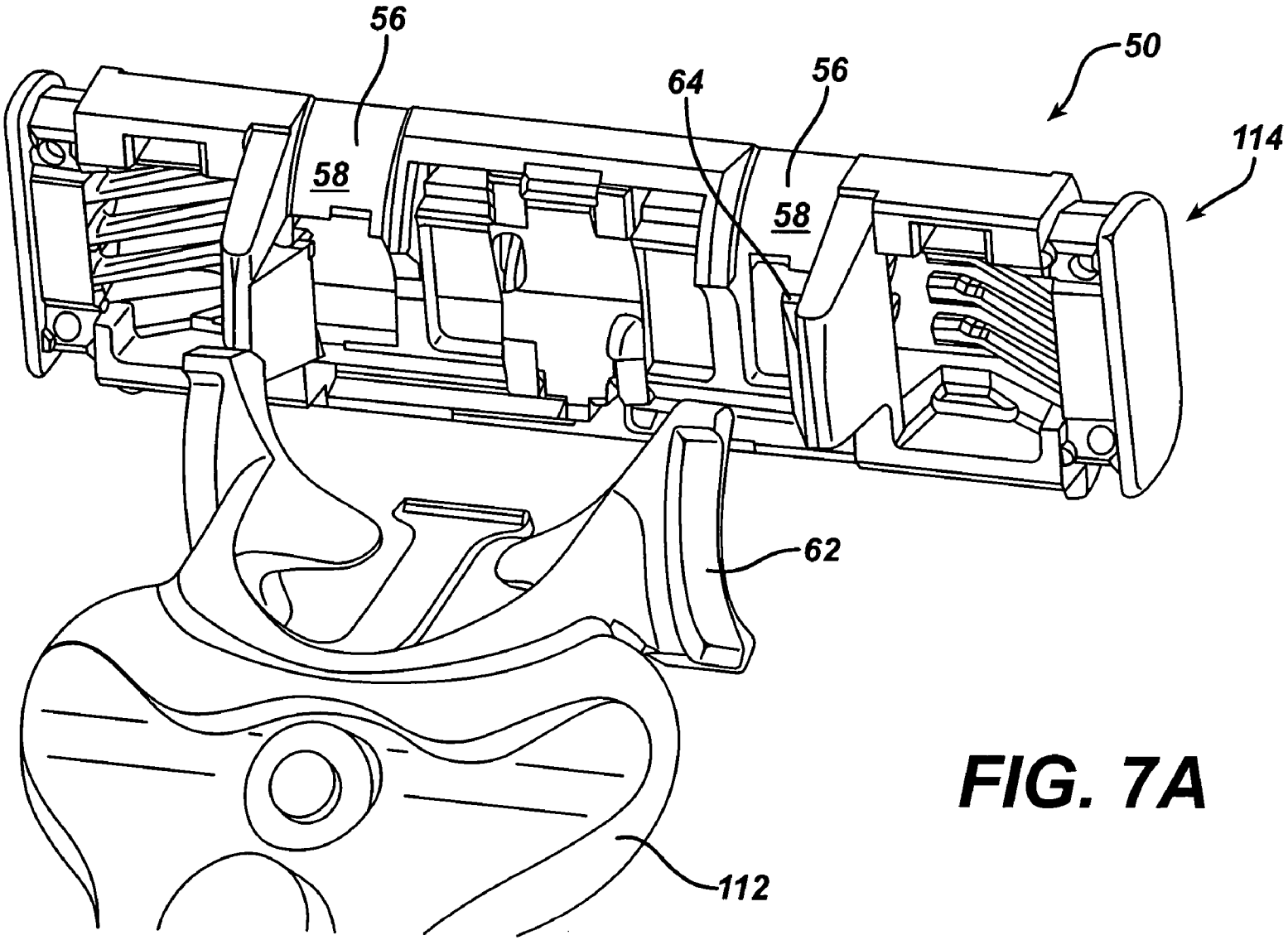
Figure 7B:
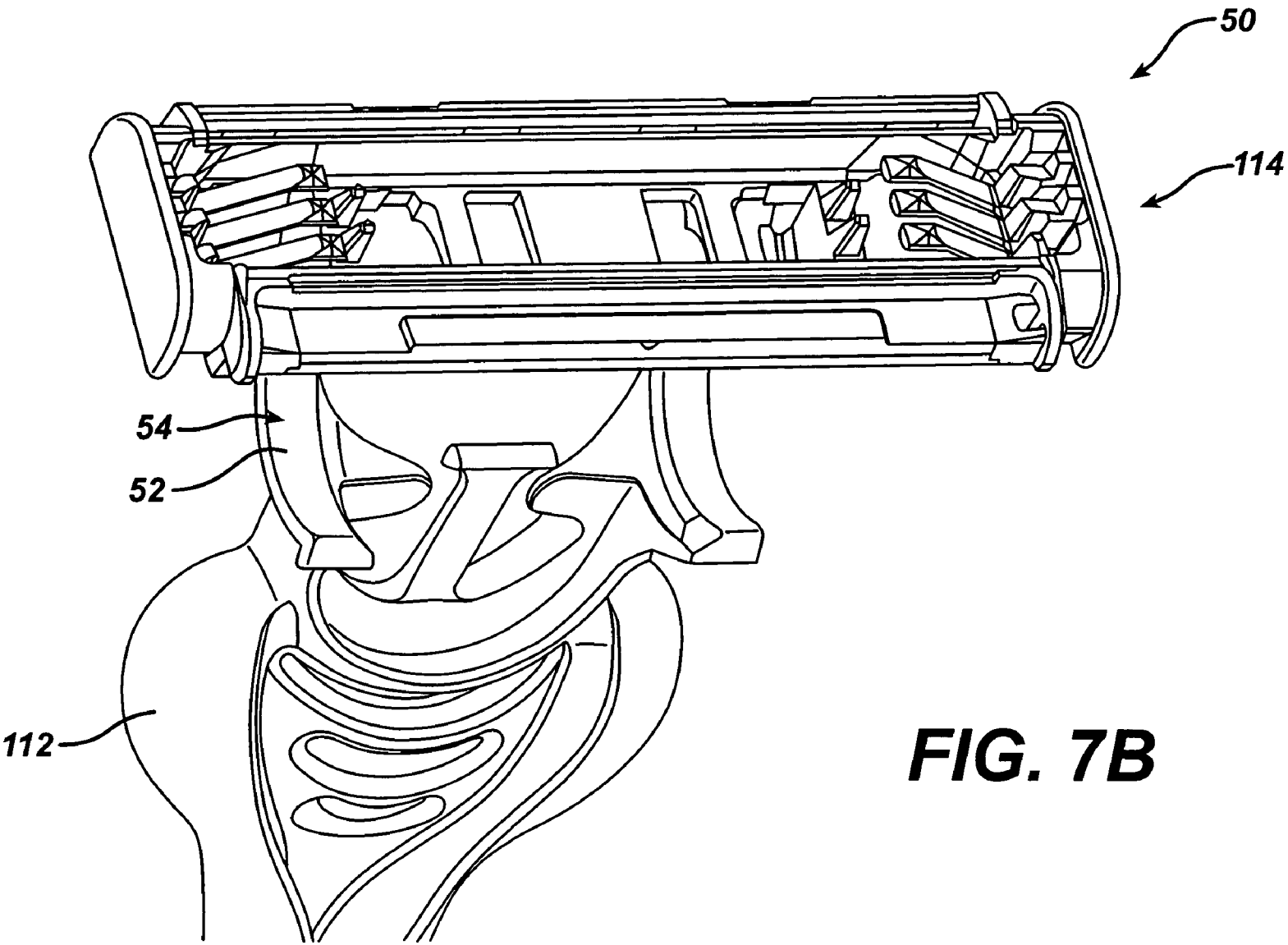

For example, while certain razor designs have been shown and described above by way of example, the features described herein may be used in any desired razor design. As one example, the razor 50, shown in FIGS. 7A-7B, includes the same type of electro-mechanical connector described above. Due to differences in the pivoting design of razors 10 and 50, the electrical contacts are positioned differently in razor 50. Razor 50 includes contacts 52, disposed on arcuate bearing surfaces 54 of the handle 112 (FIG. 7B), positioned to engage contacts 56 on the corresponding bearing surfaces 58 of cartridge 114. Razor 50 may also include contacts in other locations, e.g., contacts 62 on the handle 112 which are positioned to engage contacts 64 on the cartridge 114 (FIG. 7A).

Additionally, a portion of the conductive path CP, may be discontinuously plated so that the conductive path is completed intermittently, e.g., when the razor cartridge is in a certain position the conductive path is continuous, while when the razor cartridge is in a different position the conductive path is broken. For example, end portions 38 may be plated in some areas and unplated in other areas, with the plating pattern being such that the circuit is completed when the cartridge is in a pivoted position (e.g., during shaving) and the circuit is open when the cartridge is in its "at rest" unpivoted position (e.g., when the user is not shaving). This arrangement provides a safety shut-off, causing the electrical function of the razor to be turned off when the user is not shaving. If the electrical function is heating, this feature will reduce the risk of the razor cartridge overheating.

Moreover, the features described above may be used in both men's and women's razors.

What is claimed is:

1. A razor comprising:

a handle including a pair of contacts, a head, separable from and pivotally mounted on the handle, the head including a housing that is positioned to contact the user's skin during shaving and that carries one or more blades configured for wet shaving, an electrical circuit, configured to power an electrical function associated with the head, a first portion of the circuit being disposed in the handle and a second portion of the circuit being disposed in the head, and an electro-mechanical connector, interposed between the head and handle and pivotally joining the head to the handle, configured to provide electrical communication between the first and second portions of the circuit, the electro-mechanical connector comprising (a) a handle-receiving portion containing contacts disposed for contact with the contacts of the handle, (b) a pair of wings that extend from the handle-receiving portion, and (c) a pair of clips that are joined directly to the end portions of the wings to form a pivotable connection and an electrical connection, the clips are crimped around a portion of the housing to hold said blades in place in the housing and to provide a path for current from the contacts of the handle-receiving portion to the housing.

2. The razor of claim 1 wherein the electrical circuit is configured to heat the housing.

3. The razor of claim 1 wherein the electro-mechanical connector includes lead wires embedded in the pivot journals.

4. The razor of claim 1 wherein the electro-mechanical connector is configured to provide intermittent electrical communication.

5. The razor of claim 4 wherein the electro-mechanical connector includes a conductive path that is discontinuous so that when the head is in a certain position the conductive path is continuous, while when the head is in a different position the conductive path is broken.

6. The razor of claim 1 wherein the razor is configured to vibrate during shaving.

7. The razor of claim 6, wherein the razor further comprises a motor and an oscillating member mounted on a shaft of the motor, so as to produce vibration when the motor is energized.

8. The razor of claim 6, wherein the razor further comprises a linear motor configured to produce vibration when the motor is energized.

9. The razor of claim 1 further comprising a power source in electrical communication with the electrical circuit.

10. The razor of claim 9 wherein the power source comprises a battery.

11. The razor of claim 9 wherein the power source is disposed within the handle.

12. The razor of claim 9 wherein the power source is rechargeable.

13. The razor of claim 12 wherein the razor is configured to be mounted in electrical communication with a recharging station.

* * * * *